US006601490B1

(12) United States Patent
Gross et al.

(10) Patent No.: US 6,601,490 B1
(45) Date of Patent: Aug. 5, 2003

(54) PROCESS FOR FORMING AND FOR THE FURTHER PROCESSING OF SMALL STACKS OF SHEET MATERIAL

(75) Inventors: Helmut Gross, Hofheim/Taunus (DE); Adolf Rasch, Wuesbaden (DE); Horst Schneider, Hofheim/Taunus (DE)

(73) Assignee: Adolf Mohr Maschinenfabrik GmbH & Co. KG, Hofheim (DE)

( * ) Notice: Subject to any disclaimer, the term of this patent is extended or adjusted under 35 U.S.C. 154(b) by 0 days.

(21) Appl. No.: 09/473,354

(22) Filed: Dec. 28, 1999

(51) Int. Cl.[7] ..... B26D 7/01; B26D 7/18

(52) U.S. Cl. ..... 83/27; 83/36; 83/91; 83/93; 83/698.21; 83/468.5; 83/468.6; 83/468.7

(58) Field of Search ..... 83/35, 36, 27, 83/29, 91, 93, 698.21, 467.1, 468.5, 468.6, 468.7

(56) References Cited

U.S. PATENT DOCUMENTS

| | | | | | |
|---|---|---|---|---|---|
| 3,146,650 | A | * | 9/1964 | Sarring et al. | 83/91 |
| 3,238,824 | A | * | 3/1966 | Jallo | 83/36 X |
| 3,546,990 | A | * | 12/1970 | Schneider et al. | 83/27 |
| 4,850,257 | A | * | 7/1989 | Mohr | 83/93 |
| 5,127,294 | A | * | 7/1992 | Mohr | 83/36 X |
| 5,150,647 | A | * | 9/1992 | Mohr | 83/93 X |
| 5,209,149 | A | * | 5/1993 | Mohr | 83/91 |
| 5,279,196 | A | * | 1/1994 | Mohr | 83/91 |
| 5,311,799 | A | * | 5/1994 | Mohr | 83/36 |
| 5,709,023 | A | * | 1/1998 | Lallement | 83/29 X |
| 5,887,505 | A | * | 3/1999 | Mathian | 83/468.7 |
| 6,012,367 | A | * | 1/2000 | Westra et al. | 83/36 X |

FOREIGN PATENT DOCUMENTS

| | | | |
|---|---|---|---|
| EP | 056874 A2 | * | 8/1982 |
| EP | 242763 A2 | * | 10/1987 |
| EP | 453933 A1 | * | 10/1991 |
| WO | WO 91/00168 | * | 1/1991 |

* cited by examiner

*Primary Examiner*—Charles Goodman
(74) *Attorney, Agent, or Firm*—Price, Heneveld, Cooper, DeWitt & Litton

(57) ABSTRACT

A process for forming small stacks from an initial stack of sheet material by cutting includes providing a single guillotine cutter machine which comprises a rear table part for receiving the material to be cut and a front table part for receiving the cut material, separating the initial stack into partial stacks by a plurality of cuts in a first direction perpendicular to a direction of feed thereof, and pushing back and rotating 90° at least a portion of the partial stacks from the front table part onto the rear table part for further cutting. The process also includes installing a first movable guide plate above the front table part, placing the partial stacks such that the partial stacks abut the guide plate, and cutting the partial stacks to produce small stacks. The process further includes moving apart the front and rear table parts to form a gap between them, placing a second movable guide plate in the region of the gap, and transporting the small stacks through a transverse channel formed between the two guide plates to a further processing station.

20 Claims, 16 Drawing Sheets

FIG.16
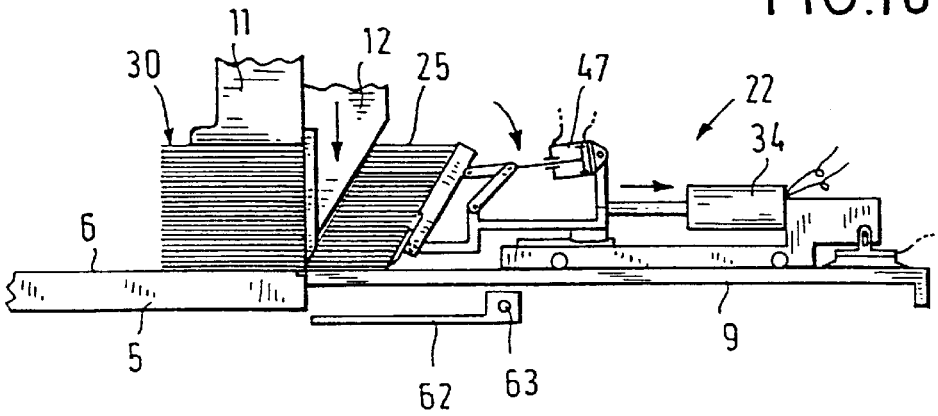
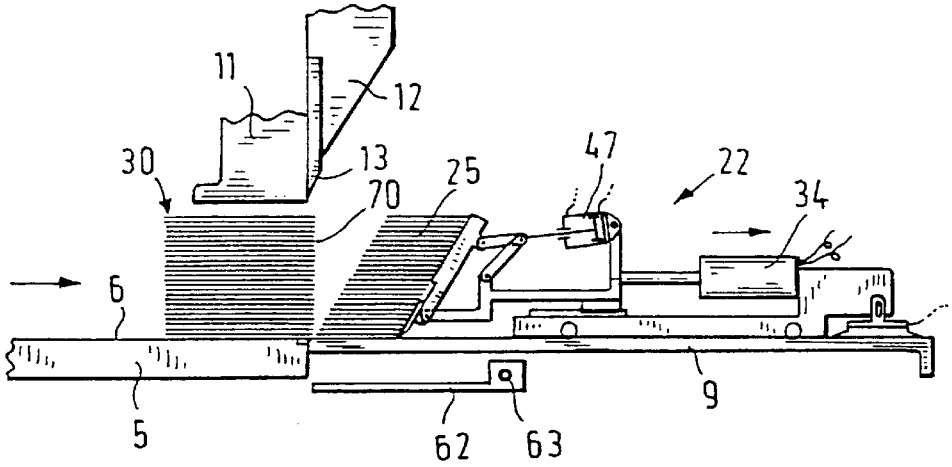
FIG.17

53
84
85
56
33
38
39
52
41
43
42
51
40
34
36
45
48
46
47
31
83
81
80
82
72
32
22

PROCESS FOR FORMING AND FOR THE FURTHER PROCESSING OF SMALL STACKS OF SHEET MATERIAL

This invention relates to a process for forming and for the further processing of small stacks of sheet metal.

BACKGROUND OF THE INVENTION

A process is known in practice for forming small stacks from an initial stack of sheet material by means of cutting, with subsequent transfer of the small stacks to a further processing station. In this process a single guillotine cutter machine is used. The latter comprises a rear table part for receiving the material to be cut and a front table part for receiving the cut material. The initial stack, which is in the shape of a right parallelepiped, is first separated into partial stacks by a plurality of cuts in a first direction perpendicular to its direction of feed. All these partial stacks, or part of these partial stacks, are subsequently subjected to further processing. For this purpose, the partial stacks to be processed are pushed, turned by 90°, from the front table part on to the rear table part for further cutting. The partial stacks are separated by at least one cut in a second direction in order to form the small stacks. The small stacks which are thus produced are fed manually, perpendicularly to the direction of feed of the guillotine cutter machine, to the further processing station, after they have previously been pushed manually slightly forward in the direction of feed, so as to be able to move them laterally past the housing of the cutting machine.

A guillotine cutter machine which can be operated according to the process described above is known from EP-A-0 056 874, for example. Processing cannot be carried out automatically with this machine, and in particular cannot be carried out automatically with respect to the cut for producing the small stacks and the transfer thereof to the further processing station. The latter can be an automatic bundling machine or a label punch, for example.

Furthermore, other apparatuses are known which enable small stacks of sheet material to be formed and further processed in an automated manner. However, these apparatuses are only suitable for carrying out defined processing steps during the formation and further processing of small stacks of sheet material, so that costly machine constructions, or at least two guillotine cutter machines, are necessary in order to cover the entire course of processing.

It is known from EP-A-0 242 763 that edge cuts which may be necessary can be made on the stack by a first guillotine cutter machine, after which the stack is present as an initial stack, and that the initial stack can also be separated into partial stacks by this machine. The partial stacks are collected on a support and are fed to the second guillotine cutter machine, which is disposed perpendicularly to the first-mentioned guillotine cutter machine. In the second cutter machine, the partial stacks are subdivided, on each cut, into small stacks which are arranged in rows. A first guide plate is disposed in front of the partial stacks with respect to the direction of feed of the material, and is thus disposed in the region of the front table part. A second guide plate can be introduced into a gap formed between the front and rear table parts, adjacent to the rear end of the front table part. The two guide plates form a transverse channel between them which receives the small stacks, which can be fed to a further processing station by means of an ejector.

Quite a costly process for cutting and for the further processing of small stacks of sheet material is known from WO 91/00168 A. This process employs a machine of complicated construction. The front table part of the machine is of two-part construction, wherein the front section of the table part is raised after separating the initial stack into partial stacks, so as thus to be able to bring a first movable guide plate, which is disposed underneath the front section of the front table part, into position in order to form small stacks in connection with the further separation of the partial stacks. Whereas the rear section of the front table part is fixedly mounted in a base frame which can be moved horizontally, the front section of the front table part is mounted in a vertically movable intermediate frame, which is mounted in the base frame and which, underneath the front section of the front table part, receives the first guide plate and elements for horizontally moving and swivelling said guide plate. The first guide plate thus forms a fixedly installed component of the front table construction. The operating procedure of this machine is costly, since due to its division into two regions the front table part is not only movable horizontally but is also movable vertically over a relatively large vertical distance.

EP-A-0 453 933 describes a process for cutting and for the further processing of small narrow stacks of sheet material. The guillotine cutter machine which is illustrated there can only produce stacks of constant dimensions as seen in the direction of feed of the material. An L-shaped element for receiving the cut small stacks is provided for this purpose. The lower arm of the L-shaped element fits under the small stacks, whilst the other arm serves as a lateral support for the stacks. The L-shaped element is mounted so that it can be moved and swivelled horizontally in a front table part of the guillotine cutter machine, but this table part is not employed for receiving the cut material. The purpose of this type of mounting of the L-shaped element is to enable the L-shaped element to be tilted away when separating the partial stacks by means of the wedge-shaped cutter and thus when forming small stacks which are initially displaced into the shape of a parallelogram, whilst the front edge of the L-shaped element remains in a plane with the table surface.

SUMMARY OF THE INVENTION

The object of the present invention is to further develop a process according to the precharacterising clause of claim 1 which, using one and the same guillotine cutter machine and a simple mode of operation, not only enables the steps to be carried out for producing partial stacks and small stacks, but which also creates conditions when this machine is used such that the small stacks can be fed automatically to further processing operations.

This object is achieved by a process according to the features of claim 1.

According to the invention, it is not until the partial stacks have been pushed back on to the rear table part, whereupon the partial stacks can rest in part on the front table part, that the first movable guide plate is installed above the front table. Before this, namely before the installation of the first guide plate, the entire table surface of the table, particularly the table surface of the front table part, is free, so that the material can be manipulated there in any desired manner, and in particularly can be turned after the cuts have been made for producing the partial stacks. It is also possible, using the guillotine cutter machine, to trim the edges of the initial stack before it is separated into partial stacks. The first movable guide plate is not installed until the front table part is no longer required for manipulating the material. Process steps which proceed automatically can be carried out by means of this guide plate, particularly in cooperation with the second movable guide plate.

Thus, the essential difference between the process according to the invention and that disclosed in WO 91/00168 A is that, according to the present invention, the first movable guide plate is installed above the front table part after the partial stack has been pushed back on to the rear table part, whilst according to the aforementioned prior art this first movable guide plate is fixedly installed underneath the front table part and is also permanently positioned underneath the front section of the front table part. Therefore, with the front section of the front table part raised, it is not possible to separate the front and rear table parts which are disposed in a plane in order to form a gap between them and in order to form the transverse channel between the two guide plates for the small stacks which are to be transported away.

According to the present invention, the partial stacks are placed in the region of the guide plate, wherein "placement" is to be understood here to comprise both the placement of the guide plate with respect to the stationary partial stacks and the displacement of the partial stacks into the region of the guide plate which is already installed. In particular, the partial stacks are placed against the guide plate. This is followed by the cut for producing the small stacks, and the front and rear table parts are then moved apart in order to form the gap between them. The second movable guide plate is then placed in the region of the gap and the two stacks are fed to the further processing station through the transverse channel formed between the two guide plates. In this respect it is unimportant whether the second movable guide plate is placed from below, namely through the gap, or from the side or from above. The crucial feature is that the transverse channel is formed by the two guide plates. After the small stacks have been transported away, and in particular have been ejected, towards the further processing station, the partial stacks situated on the rear table part are moved forwards into the region of the first guide plate, and this is followed by the next sequence of cuts in the sense described above.

As has been described previously in the prior art according EP-A-0 242 763, the movement of the first guide plate in particular has to be adapted to the conditions for cutting the small stacks. This makes it necessary to provide horizontal mobility of the first guide plate and to ensure that the latter can swivel.

Apart from this, since the first guide plate is a mobile component which has to be installed, it is necessary to position the first guide plate in a defined manner with respect to the front table part or with respect to the partial stacks to be cut, in order to ensure the sequence of movements of the first guide plate which were described above. According to a special feature of the present process, when the first guide plate is installed it is positioned against the partial stacks to be cut. In particular, if when the first guide plate is installed it is positioned against the partial stacks disposed with their front faces in the cutting plane, it is ensured that the guide plate is associated with a defined, fixedly predetermined plane, namely with the cutting plane of the cutter. The coordinates of movement of the first guide plate can thus be fixed with respect to the cutting plane. On the other hand, it is possible to effect a variable association of the contact face of the first guide plate in relation to the cutting plane. This means that the plane of contact of the first guide plate is positioned at an arbitrary spacing from the cutting plane, and the position of the guide plate, particularly its position in relation to the cutting plane, is determined by means of electronics. In particular, the electronics thus determine how far the vertically positioned plane of contact of the guide plate is from the cutting plane, and take this into account during the current cutting process. It is known from the prior art that the positions of machine parts, for example the position of the feed cradle of the cutting machine with respect to the cutting plane, can be determined and represented by means of electronics. The position of the first guide plate can be represented correspondingly.

The transfer of data between the mobile alignment station and the overall control system of the guillotine cutter machine, particularly with respect to the operation of the actuating elements of the mobile alignment station, of the elements for fixing the mobile alignment station to the front table part, and of the elements for determining the position of the mobile alignment station relative to the material to be cut or relative to the cutting plane of the cutters, can also of course be effected by means of remote control, infrared control or the like.

In a further embodiment, after the partial stack has been pushed back on to the rear table part, a mobile alignment station, which receives the first guide plate, is placed on the front table part. After the partial stack has been pushed back on to the rear table part, the mobile alignment station is advantageously moved on to the front table part from an additional table part disposed at the side. In particular, this is effected manually. The receiving planes of the rear table part and of the additional table part can be permanently aligned with each other here, so that when the mobile alignment station is not required it is placed on the additional table part beside the front table part. A certain disadvantage here is that this region is not available to the operator so that he can freely manipulate the material to be cut. Taking this situation into consideration, it is proposed that the additional table part comprises two parallel table planes disposed one above the other, wherein the lower table plane serves to receive the mobile alignment station before it moves on to the front table part and the two table planes of the additional table part can be raised and lowered with respect to the table plane of the front table part. If the mobile alignment station is not required, the additional table part is situated in its lowered position, so that the upper table plane of the additional table part forms a plane with the table plane of the front table part and this region can thus be used for working in without any restriction. If the mobile alignment station is required, the additional table part is raised by an extent such that its lower table plane is aligned with the table plane of the front table part, whereby the mobile alignment station can be transferred without difficulty on to the front table part. If necessary, the additional table part is lowered on to the front table part again whilst the mobile alignment station is in use.

After it has been transferred on to the front table part, the mobile alignment station is preferably attached thereto or to a lateral stop associated with this table part, particularly by means of suction force or magnetic force. It is thereby ensured that the mobile alignment station permanently assumes its desired position in relation to the front table part, which is a prerequisite for the operation of the guide plate.

The material to be cut can be aligned in a simple manner by means of the guide plate of the mobile alignment station. After a cut is made, a displacement of the upper sheets of the material to be cut generally occurs, so that the material can be aligned on the device for feeding the material by moving the first guide plate against the front edge of the material to be cut.

According to a further fundamental embodiment of the process according to the invention, when the first guide plate is installed it is positioned in a defined manner with respect to the front table part. The first guide plate is thus not aligned on the material to be cut, but is aligned on the front table part. In particular, the mobile alignment station which receives the first guide plate can be positioned in different positions on the front table part with respect to the cutting plane of the cutter of the guillotine cutter machine. This takes into account the fact that small stacks have to be cut which have different extents in the direction of feed of the material, and the aim should be to achieve short distances of travel of the guide plate. In this respect, the front table part comprises diverse receivers in planes parallel to the cutting plane of the cutter, for example in three planes, wherein peg-like elements attached to the mobile alignment station can be brought into active communication with said receivers. Since one definitive requirement for the positioning of the mobile alignment station with respect to the front table part is to align the contact face of the first guide plate so that in its initial position it is exactly parallel to the cutting plane of the cutter, provision is made for centring the mobile alignment station on the front table part.

After the partial stacks have been moved forwards, or in the final phase of movement of the partial stacks, the first guide plate is preferably moved in the opposite direction to the direction of feed of the partial stacks, so that the partial stacks are aligned on the feed cradle of the cutting machine. This precise alignment of the partial stacks is a particular prerequisite for a high accuracy of cut when producing the small stacks, particularly when the latter are labels. When the partial stacks are cut, the first guide plate is swivelled so that it is tilted away from the cutter corresponding to the wedge shape of the cutting knife. The electronics preferably detect the downward movement of the cutting knife and control the actuator for swivelling the first guide plate in accordance with the passage of the cutting knife through the partial stacks. Superimposed on this, or subsequently thereto, there is a slight horizontal movement of the first guide plate away from the cutting plane, in order to effect the complete movement of the small stack, which is displaced into the shape of a parallelogram, on to the front table part when the second guide plate is aligned vertically and is completely seated against the rear edge of the front table part. The aforementioned overhang of the small stacks is due to the cutting plane or the cutting strip being disposed in the rear table part slightly offset in relation to the interface between the front and rear table parts. When the second guide plate is disposed vertically, the first guide plate tilts into its vertical position.

The first guide plate can preferably both move horizontally and swivel horizontally. In particular, it can move by differently defined distances. For example, it can be moved by an extent of advance for producing the small stacks, by an extent of advance for compensating for the swivelling movement of the first guide plate, or by an extent of advance for an intermediate cut, particularly in combination with the disposal of the cutting waste through the gap. The guide plate is moved or swivelled in particular by a pneumatically or electrically acting means of force, preferably by means of an electric servomotor.

It is considered to be particularly advantageous if the turned partial stacks are fixed between one or more movable contact placement devices and a fixed lateral contact placement device of the rear table part. This is generally effected before or during the cut in the second direction. A procedure of this type is particularly advantageous when narrow sheets are to be cut, whereby it is ensured that they are aligned exactly parallel to each other and the partial stack associated with the fixed lateral contact placement device is seated flat against the latter.

It is essential that the process according to the invention can be employed for what is termed mixed production. This means that after cutting small stacks, the extent of which is slight in the direction of feed, small stacks have to be cut under some circumstances, the extent of which in the direction of feed is greater. These operations can be put into effect in a simple manner by moving the guide plate of the mobile alignment station or by displacing the mobile alignment station.

Other features of the process according to the invention are presented in the description of the Figures and in the subsidiary claims, where should be remarked that all individual features and all combinations of individual features constitute the essence of the invention.

The process according to the invention is illustrated in the Figures, which comprise a plurality of embodiments of a guillotine cutter machine which operates according to this process, without being limited to the specific process steps described. The Figures are as follows:

BRIEF DESCRIPTION OF THE DRAWINGS

FIGS. 16 to 19 illustrate processing steps which are inserted when making an intermediate cut between the main cutting operations;

DETAILED DESCRIPTION OF THE PREFERRED EMBODIMENTS

Figure 1:
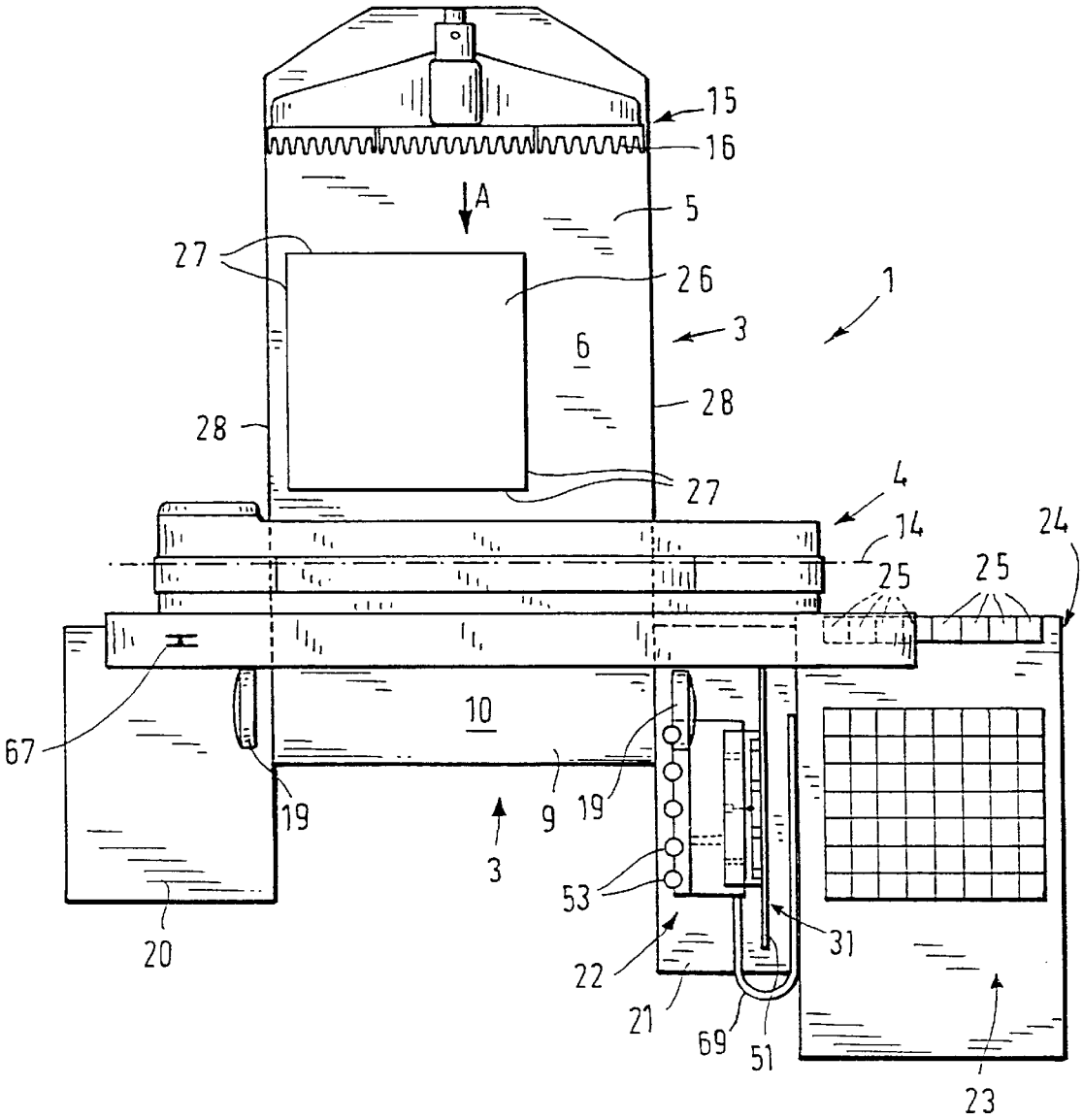
FIG. 1 is a plan view of a first embodiment of the guillotine cutter machine, with a mobile alignment station, which is situated in its out-of-use position, placed on a side table, and with a stack of cut material resting on the rear table part before the edge trimming operation.
Figure 5:
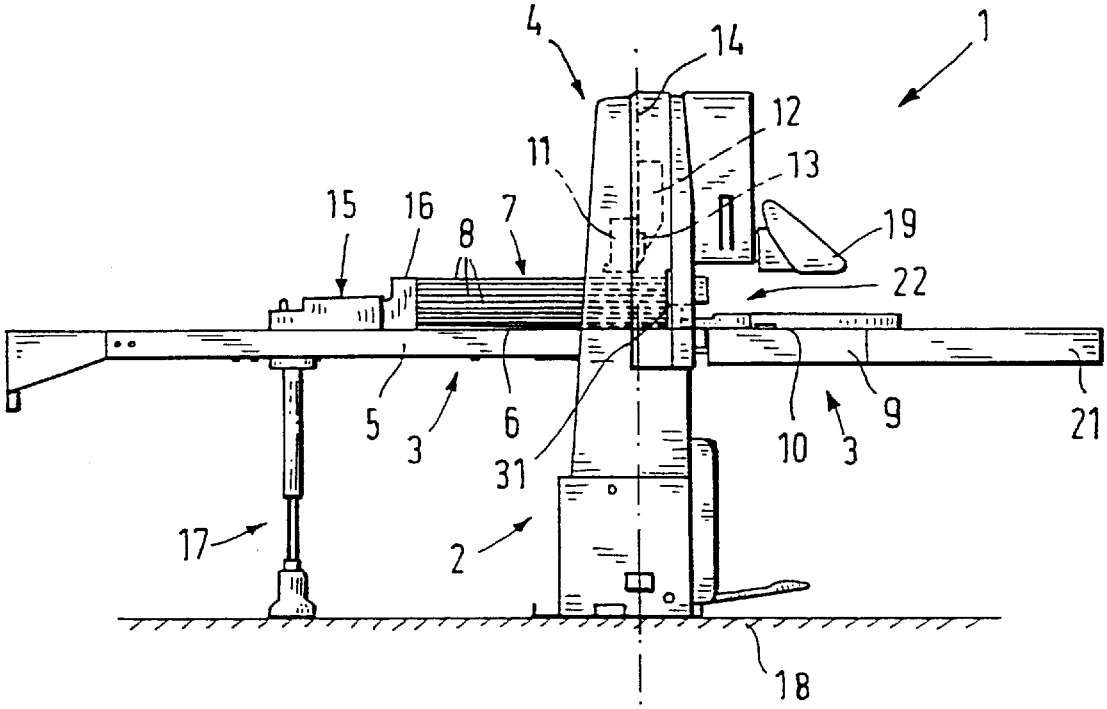
FIG. 5 shows a cut being made by the cutting machine along line V—V of FIG. 4.

The basic design of the guillotine cutter machine can be seen from the illustrations of FIGS. 1 and 5. The guillotine cutter machine 1 comprises a stand 2, a table 3 supported by the stand and a gantry frame 4 which extends above the table 3. A rear table part 5 with table surface 6 serves to receive the material to be cut 7, which consists of stacked sheet material. The individual layers of sheets are denoted by reference numeral 8. A front table part 9 serves to receive the cut material in the region of its table surface 10. A press crosshead 11, which is placed above the rear table part 5 and can be lowered on to the material to be cut 7, is mounted in the gantry frame 4. A cutter support 12 is movably mounted in front of the press crosshead 11 in the gantry frame 4. A cutting knife 13 is screwed to the cutter support in the region of the lower end thereof. The lower ends of the cutting knife 13 and of the cutter support 12 are of wedge-shaped construction, wherein the face of the cutting knife 13 which faces the press crosshead 11 is positioned perpendicularly to the table surfaces 6 and 10 and the cutting plane 14 is thereby formed. A cutting strip, which is not shown, is embedded in the rear table part 5 below the cutting knife 13, at a short distance from the interface between the rear table part 5 and the front table part 9. In its bottom dead centre position, the cutting knife 13 slightly penetrates the cutting strip, in order to ensure that even the lowermost layer of the stack of sheet material, which consists of paper, cardboard, foil or the like, is completely severed. The cutting knife is guided in the known manner in a swinging cut. In the region of the rear table part, a feed cradle 15 is mounted in the rear table part 5 so that it can move in the direction of feed A (FIG. 1) of the material 7 to be cut. The feed part 16 of the feed cradle, which comes into contact with the material 7 to be cut, is of comb-like construction at the front, and has a height which is greater than that of the maximum height of insertion of the material 7 to be cut. The drive for moving the feed cradle 15 in the direction of feed and in the opposite direction thereto is not illustrated. A plurality of pillars 17, which support the rear table part towards the floor 18, is disposed under the loaded rear table part 5.

The operating region of the person operating the guillotine cutter machine 1, who is situated in front of the front table part 9, is protected by photoelectric barriers 19 disposed on the gantry frame 4 at the side of the front table part 9. At the side of the front table part 9 there are placement tables 20 and 21, on which cut material or material to be cut can optionally be temporarily stored. The placement table 21 to the right of the operator also serves to receive a mobile alignment station 22 when the latter is not required. A further processing station 23, which can be a label punch or an automatic bundling device for example, is positioned at the side of the placement table 21. The small stacks which are cut by means of the guillotine cutter machine are fed in rows to the further processing station 23, as shown in FIG. 1. Before the last row of small stacks was fed, seven further rows had already been fed to the further processing station 23.

The procedure for forming the row of small stacks is described below, wherein a row of this type is denoted in FIG. 1 by reference numeral 24, and the respective small stacks are denoted by reference numeral 25. In the specific case illustrated, eight rows of stacks 24, each comprising eight small stacks, are cut from each initial stack.

Figure 2:
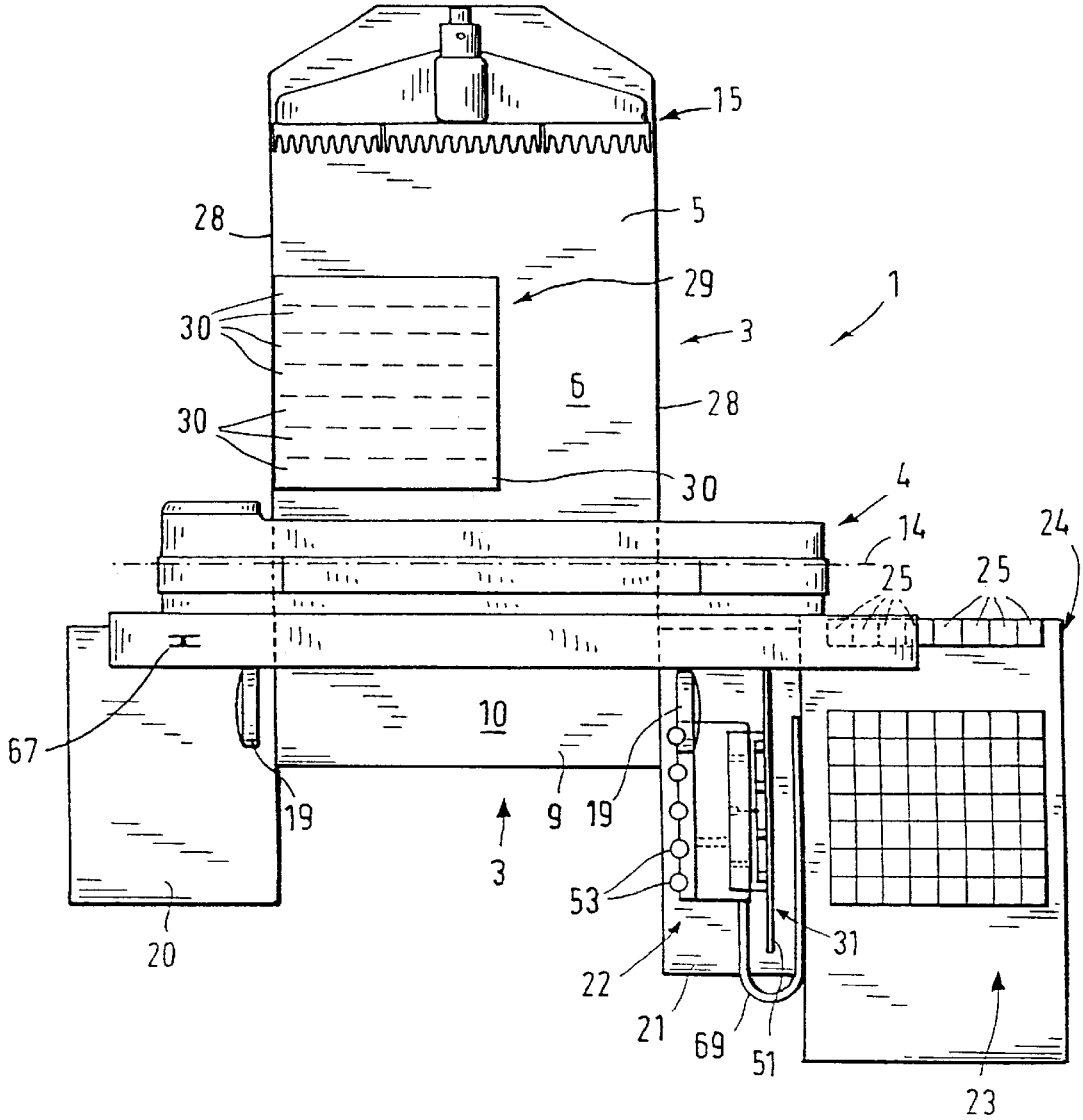
FIG. 2 is an illustration corresponding to that of FIG. 1, showing the stack of cut material resting on the rear table part after the edge trimming operation, and thus showing the initial stack resting on the rear table part before partial stacks are cut in a first direction.
Figure 3:
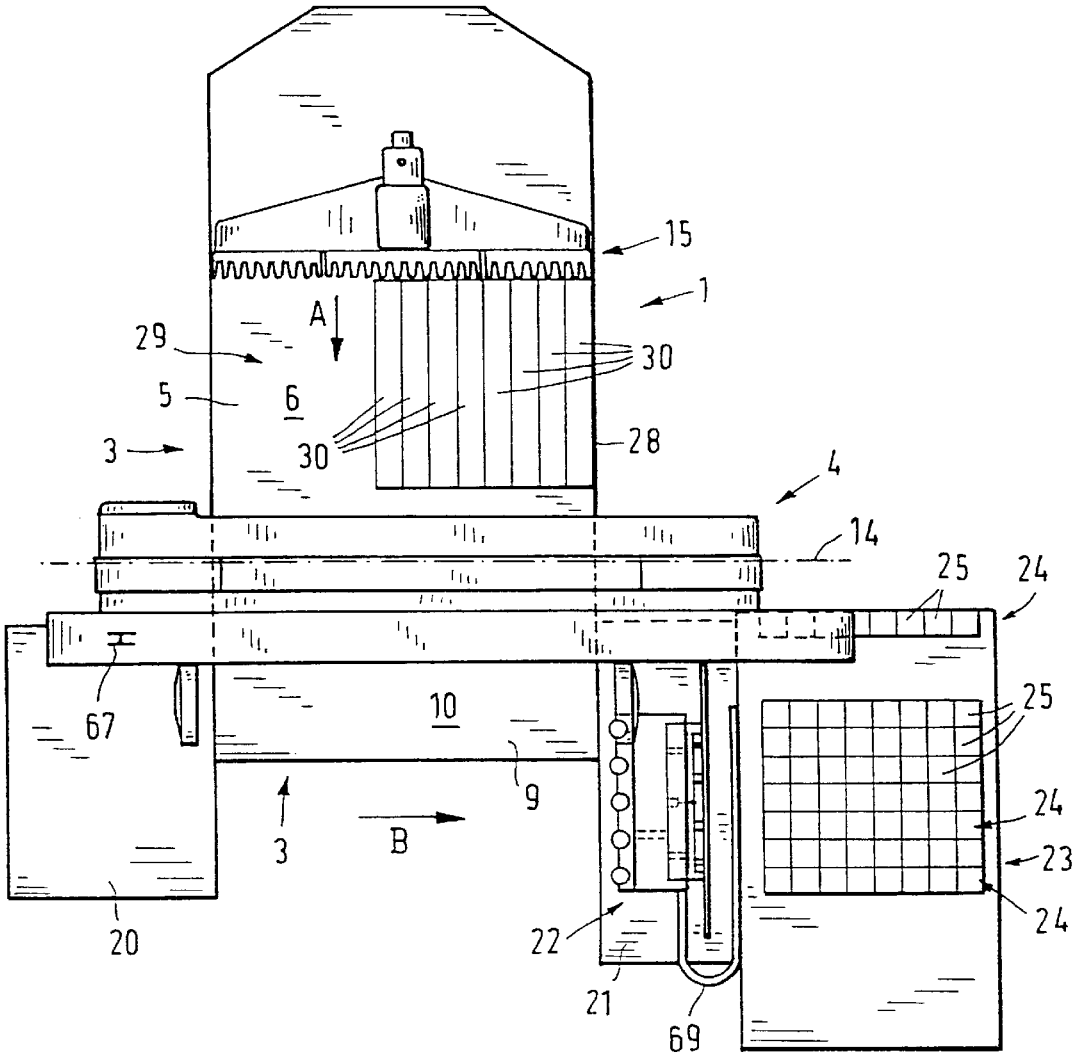
FIG. 3 is a view corresponding to that of FIG. 2, showing the partial stacks resting on the rear table part and turned by 90°, before they are cut in the second direction.
Figure 4:
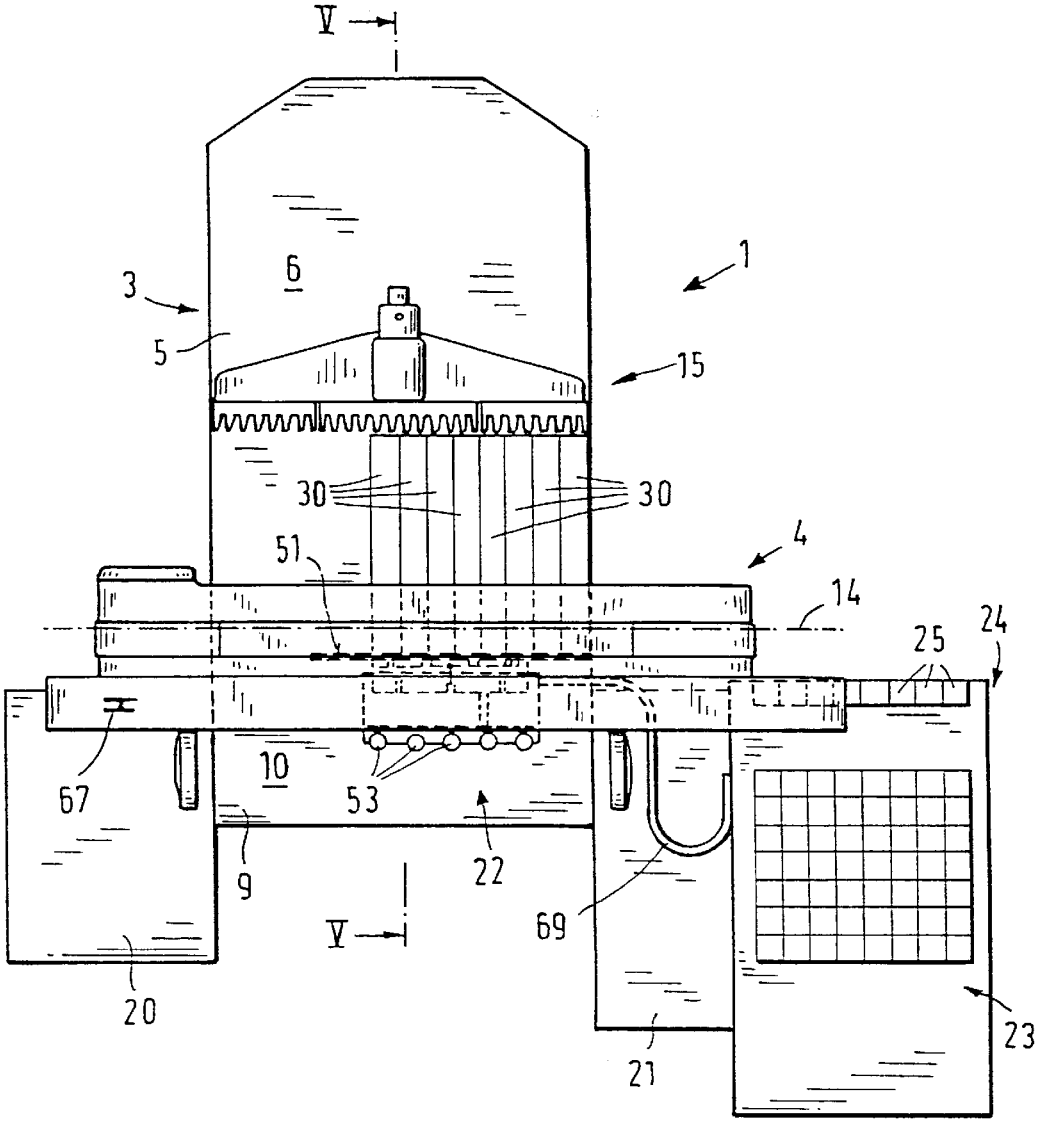
FIG. 4 shows the guillotine cutter machine of FIG. 3 with the mobile alignment station, against the guide plate of which the advanced partial stacks are seated, placed on the front table part in a position for making the first cut in the second direction for the purpose of separating the diverse small stacks.

FIG. 1 shows the mobile alignment station 22 resting on the side placement table 21, where both the rear table part 5 and the front table part 9 of the guillotine cutter machine 1 are free for working with the machine. The large stack of sheet material 26 is first trimmed at its four edges 27, by placing it each time against the lateral contact placement device 28, such as a raised edge of the rear table 5, and advancing it into the cutting position by means of the feed cradle 15. After each cut, the feed cradle 15 moves back, and the operator can pull the stack 26 forward slightly and can turn it by 90° on the front table part 9 or underneath the gantry frame 4. In order to make the next edge cut, the stack 26 is placed against the lateral contact placement device 28 and the feed cradle 15. After the four edge cuts, the initial stack 29, the dimensions of which have been reduced, is present as shown in FIG. 2. With the initial stack are illustrated by the dashed lines in FIG. 2. The cuts to be made on the initial stack 29 seated against the lateral contact placement device 28, eight partial stacks 30 are formed by seven cuts in the first direction of the initial stack 29, by successively advancing the feed cradle 15 by the predetermined extent. FIG. 3 shows these eight partial stacks 30, which are disposed side by side but which are positioned turned by 90°, in a position in which their end faces are seated against the feed cradle and in which, in the region of a partial stack 30, they are seated against the right-hand lateral contact placement device 28. Starting from here, the guillotine cutter machine is operated so that after advancing the initial stack 29 which thus exists, a cut is made in each case in order to form the eight small stacks 28 which are thereby produced, and after the front table part 9 has travelled in the direction of the arrow A these small stacks 25 are ejected perpendicularly to the direction of feed A, namely in the direction of the arrow B, towards the further processing station 23. When the small stacks 25 are cut off as shown in the illustration of FIG. 4, the mobile alignment station 22 comes into use, and as soon as the initial stack 29 no longer requires the space of the front table part 23, the mobile alignment station can be moved from the placement table 21 on to the front table part 9 and is positioned there at a defined location.

The mobile alignment station 22 can be attached to the front table part 9 by means of five suction elements 53. FIGS. 1 to 4 show an alignment station 22 which comprises suction elements 53 in a row on its side facing the operator.

Figure 8:
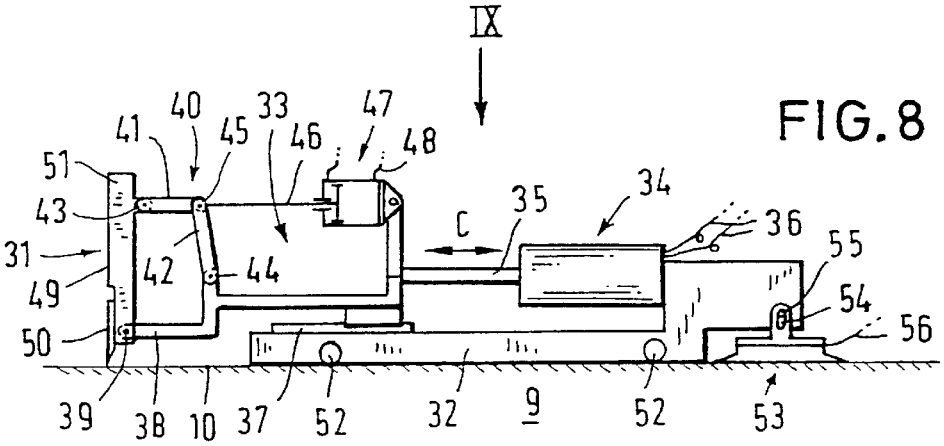
Figure 9:
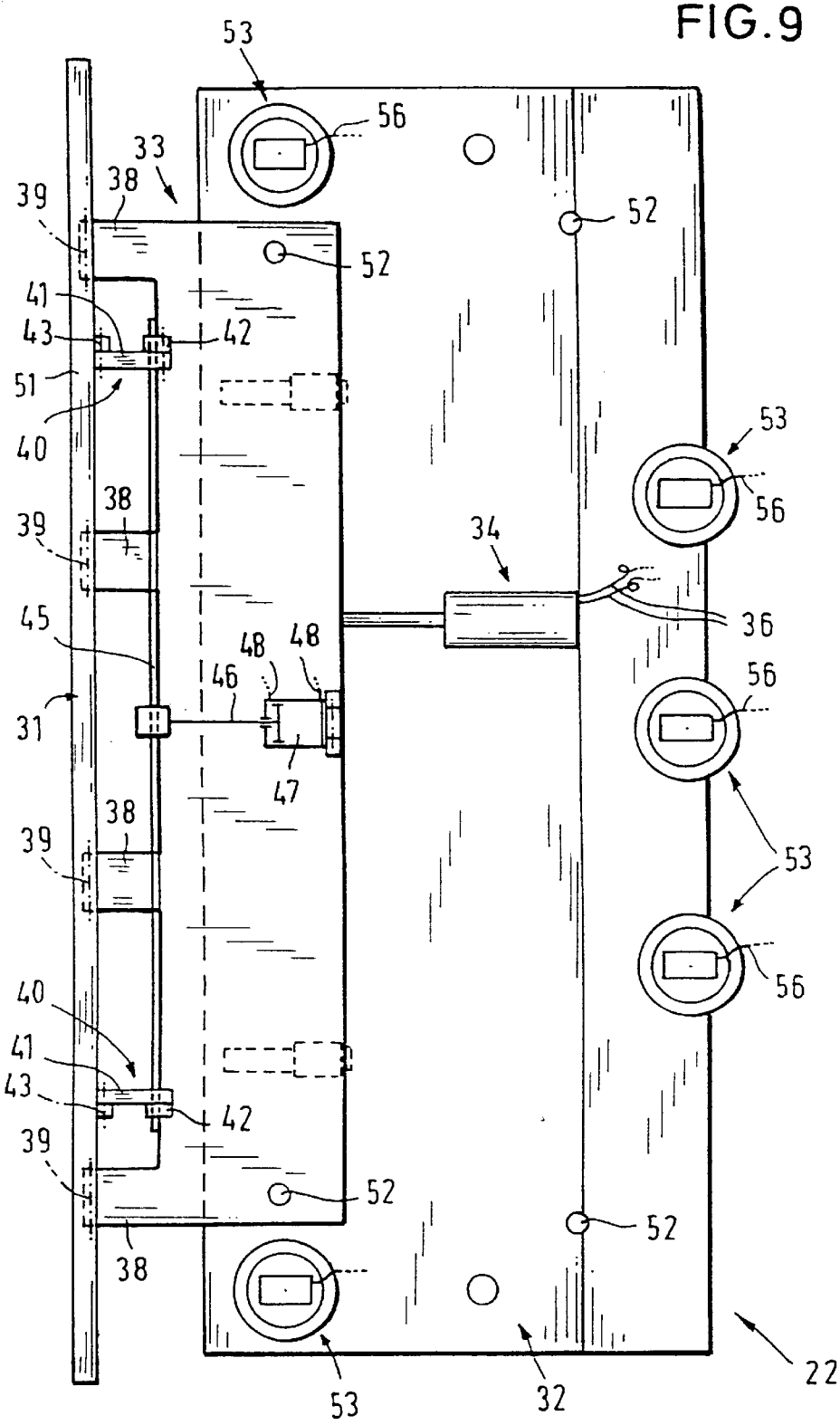
FIG. 9 is a view in direction IX of the mobile alignment station shown in FIG. 8.

The mobile alignment station 22 shown in FIGS. 8 and 9 can be fixedly attached to the front table part 9 and receives a first guide plate 31 which can travel horizontally and which can swivel about a horizontal pivot. The mobile alignment station 22 has a plate-shaped base element 32. A bearing element 33, which can be moved by means of an electric actuating motor 34, is mounted in the base element. The actuating motor is fixed at one end to the substantially plate-shaped base element 32, and acts on the bearing element 33 by means of a rod 35 which can move in the direction of the double arrows C. Reference numeral 36 denotes electrical connections for the actuating motor 34. The actuating motor can be a servomotor, for example. The plate-shaped base element 32 has two parallel guides 37 for guiding the bearing element 33. The latter is provided with four lower bearing receivers 38 in which the lower region of the guide plate 31 is mounted so that it can swivel about pivots 39. Two swivel-acting toggle levers 40 act on a middle region of the bearing element 33. The arms 41 and 42 of the respective toggle lever 40 exert a swivelling action at the top of the guide plate 31 or on the bearing elements 33, in the region of the pivots 43 and 44. A bearing spindle joins the two toggle levers 40 in the region of the joint between the respective two arms 41 and 42, and a piston rod 46 of a pneumatic cylinder 47 acts on the spindle 45, at about half the length of the spindle 45, wherein the pneumatic cylinder 47 is swivel-mounted in an upper section of the bearing element 43. Reference numerals 48 denote the pneumatic connections of the pneumatic cylinder 47. Since the coupling of the guide plate 31 at the lower coupling point thereof, namely in the region of the pivots 39, is situated above the table surface 10 of the front table part 9, and since it must be permanently ensured that the guide plate contacts the table surface 10 so that it can also act upon the lower layers of sheets of the respective stack, a plate 50 which can be displaced in the direction of the plane of contact of the guide plate 31 is mounted in the actual guide plate body 51, in the lower region of the guide plate 31 on the side thereof which faces the rear table part 5. When the guide plate 49 swivels, the lower edge of the plate 50, which is in contact with the table surface 10, can thus move in relation to the actual guide plate body 51. On its underside, the plate-shaped base element 32 of the mobile alignment station 22 is provided, substantially in the corners of the base element 32, with four running rollers 52, so that the mobile alignment station can be moved from the placement table 21 to the front table part 9 and back without having to be raised. So as to be able permanently to position the mobile alignment station 22, it is provided in a modified embodiment with three suction elements 53 in its rear region and with two further suction elements 53 in its front side regions. It should be noted that suction elements 53 may be replaced by any suitable mechanism allowing quick attachment to and release from front table part 9, such as magnetic elements and the like. These suction elements can be placed on the front table part 9 under the action of reduced pressure. The suction elements 53 can swivel about pivots 55 which are mounted in vertically extending slots 54 in the plate-shaped base element 52. Reference numeral 56 denotes pneumatic connections to the suction elements 53.

Figure 6:
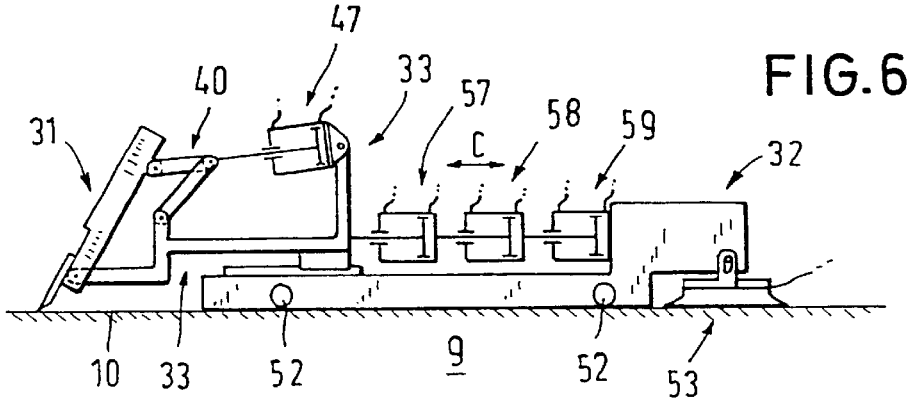
FIGS. 6 to 8 show the mobile alignment station which is circled in FIG. 5 resting on the front table part in various operating positions.
Figure 7:
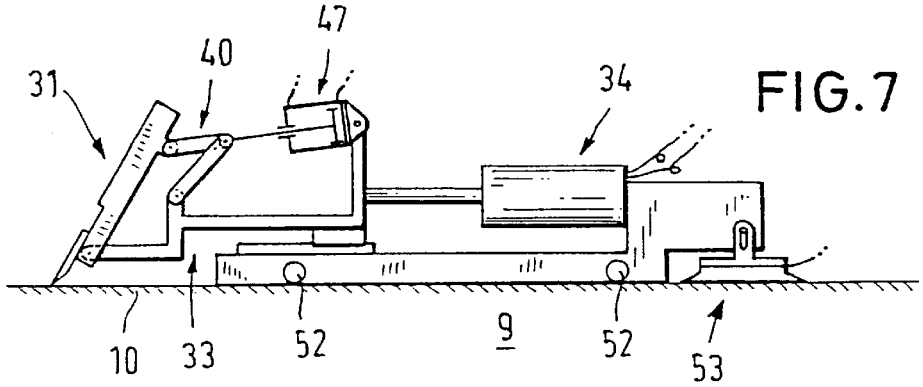

FIG. 8 shows the mobile alignment station 22 with the bearing element 33 moved back and with the piston of the pneumatic cylinder 47 extended, where the guide plate 31 has moved into its vertical position. In contrast, FIG. 7 shows the piston of the pneumatic cylinder 34 in its retracted position, and consequently shows the guide plate 31 in its swivelled position, in which it has swivelled corresponding to the parallelogram shape of the stack of cut material produced during the cut. FIG. 6 shows a form of construction which is modified compared with the forms of construction shown in FIGS. 7 to 9, in which instead of the electric servomotor 34, with which any positions can be produced, three pneumatic cylinders 57, 58 and 59 which are connected in series act between the plate-shaped base element 32 and the bearing element 33, and three different states of advance of the bearing element 33 in the direction of the double arrow C can be obtained by the positions of these three pneumatic cylinders.

The course of the procedure for cutting the small stacks 25 is described below with reference to the illustrations of FIGS. 10 to 15.

Figure 10:
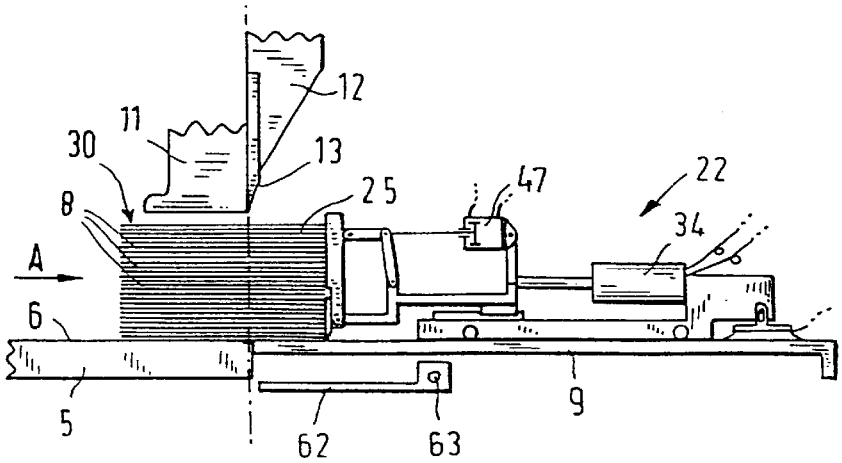
FIGS. 10 to 15 illustrate processing steps which demonstrate the mode of operation of the guillotine cutter machine without intermediate cuts between the individual main cuts.
Figure 11:
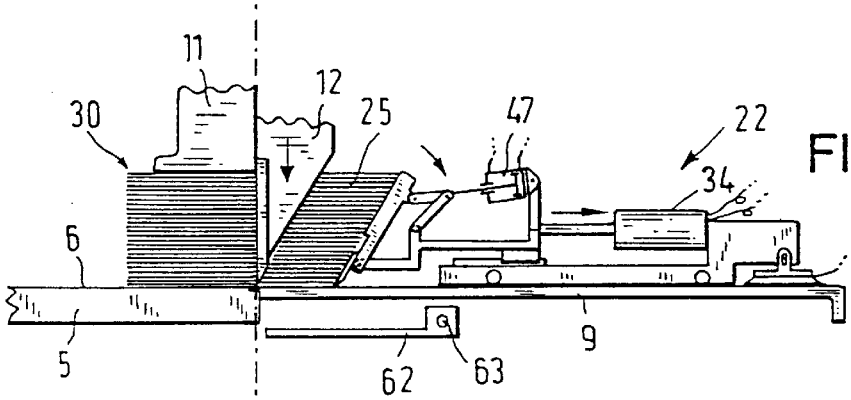
Figure 12:
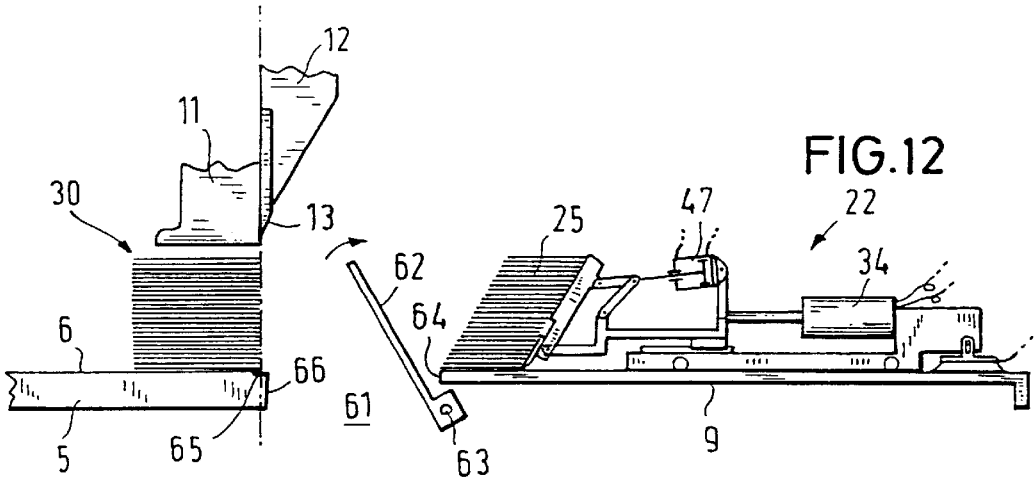

The initial position shown in FIG. 10 constitutes the situation which is reproduced in the general illustration of FIG. 4. The material to be cut, which is present as individual partial stacks 30, is advanced in the direction of feed A by means of the feed cradle 15 as far as the distance of the first cut in order to cut the initial stack in the second direction. The mobile alignment station 22 is then moved from the placement table 21 to the front table part 9 with the guide plate 31 vertical, and is positioned with the guide plate 31 against the front faces of the partial stacks 30 which face it. This position, for example, constitutes the reference position for the subsequent movements of the guide plate 31 and of the bearing element 33. The reference position can be represented in the machine electronics via the position of the feed cradle 15 and the known dimension of the initial stack 29 in the direction of feed A when the initial stack 29 is seated against the feed cradle. In this position of the mobile alignment station 22, the latter is fixedly attached to the front table part 9 by the application of reduced pressure to the suction elements 53. The suction elements 53 are operated by the machine electronics. During the subsequent cut, as shown in FIG. 11, the cutting knife 13 severs the material to be cut and thereby produces the individual small stacks 25, which are displaced into the shape of a parallelogram on account of the wedge-shaped form of the cutting knife 13 and of the cutter support 12. The pneumatic cylinder 47 associated with the toggle levers 40 is actuated via the machine electronics, said actuation being matched to the lowering movement and thus to the cutting movement of the cutting knife 13, so that the guide plate 31 swivels in the direction of the arrow, whereupon at the same time the bearing element 33 is moved away slightly from the cutting plane, since the swivel pin 39 of the guide plate 31 is positioned at a distance from the table surface 30 of the front table part 9, and due to the invariable contact area of the respective small stack 25 the movement of the plate 50 of the guide plate 31 has to be compensated for by taking into account the displacement of thereof.

Figure 13:
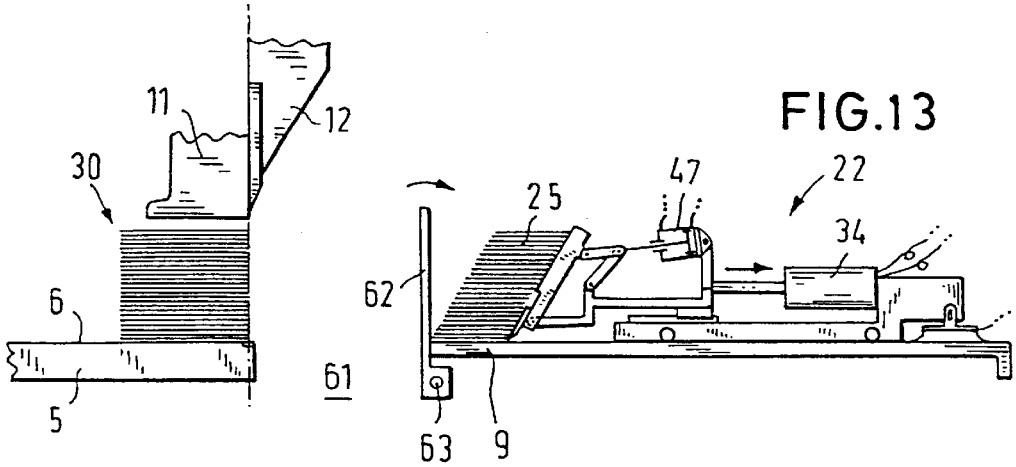
Figure 14:
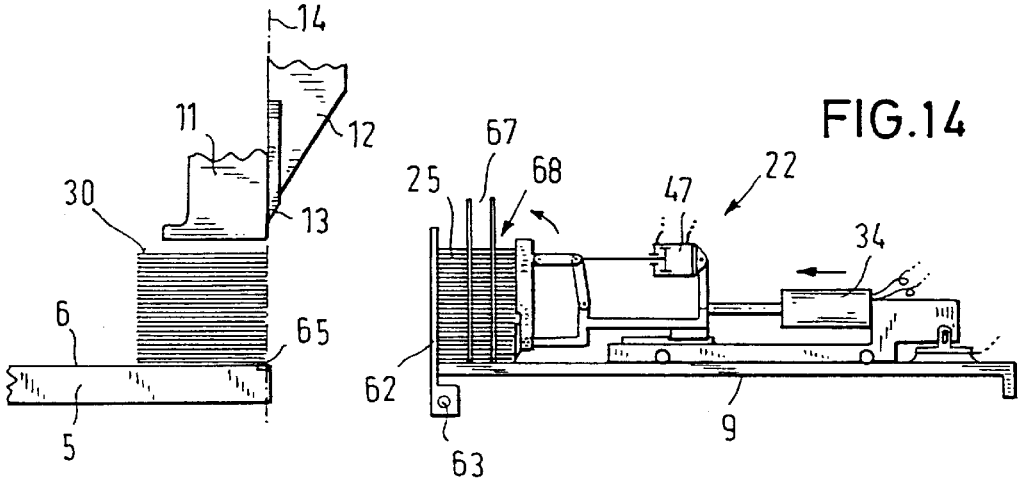
Figure 15:
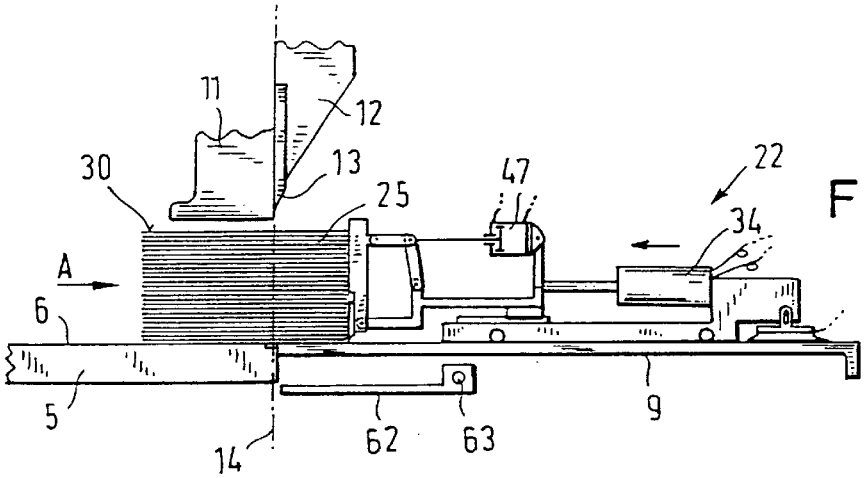

The front table part 9 is movable and can be moved from the rear table part 5 with the formation of a gap 61. A second guide plate 62 is swivel-mounted about a pivot 63 underneath the front table part 9. When the gap 61 is fully open, this guide plate, which is controlled by the machine electronics, can be swivelled via control means which are not illustrated, for example a pneumatic cylinder, towards the rear edge 64 of the front table part 9, where it is positioned vertically in relation to the table surface 10 and extends over the entire width of the front table part 9, just as the guide plate 31 does. Since for reasons of static loading the cutting strip 65 shown in FIGS. 10 to 15 is set back slightly in relation to the front edge 66 of the rear table part 5, after the cut shown in FIG. 11 the respective small stack 25 protrudes slightly beyond the rear edge 64 of the front table part 9. Before the guide plate 62 which swings in when the gap 61 opens is placed against the rear edge 64 of the front table part 9, it is therefore necessary for the guide plate 31, which is positioned corresponding to the parallelogram shape, to be moved back corresponding to this overhang, as shown by the arrow in FIG. 12, by operating the electric servometer 34 in this direction via the machine electronics, so that the guide plate 31 is moved forwards correspondingly, simultaneously with the excess displacement of the respective small stack 25, as illustrated in FIG. 13. The small stacks 25 are subsequently aligned in the shape of a right parallelepiped shape, as illustrated in FIG. 14, whereupon the guide plate 31 is swivelled back into its position perpendicular to the table surface 10 by operating the pneumatic cylinder 47 and the bearing element 33 is simultaneously moved slightly towards the second guide plate 62 by means of the electric servometer 34, in order to compensate for the difference in distance which is due to the mounting of the guide plate on the pivot 39 which is at a distance from the table surface 10. These movements are also executed by defined actuations via the machine electronics. The row of small stacks 25 which is disposed in the transverse channel 68 formed between the two guide plates 31 and 62 is subsequently transported away towards the transverse channel 68 by means of an ejector 67, which in its inoperative position is positioned in the region of the placement table 20. For this purpose, the ejector 67 is lowered behind the row of small stacks 25 and is moved towards the other placement table 21. For example, FIG. 1 shows a row 24 of small stacks such as this which was the last to be transported away, although this is shown there for the initial stack which was cut in the preceding operation. These small stacks 25 are punched or bundled in the further processing station 23.

After ejecting the row of small stacks 25, the ejector 67 is moved into its initial position shown in FIG. 4, the guide plate 62 is swung back, and by moving the front table part 9 the gap 61 between the latter and the rear table part 5 is closed again. This is followed by the advance of the material to be cut by the predetermined cut distance, in the direction illustrated in FIG. 15, whereupon the electric servomotor 34 is activated in the direction of the arrow illustrated, in order to align the complete stack, which is formed from the individual longitudinally aligned stacks, against the feed cradle 15 by means of the vertically aligned guide plate 31. This is followed by the sequence of cuts shown in the illustrations of FIGS. 11 to 14. After the last cut, and after transporting away the small stack 25 which is thereby produced, the guillotine cutter machine is moved into the position shown in FIG. 15 and the row of small stacks 25 which remains on the rear table part 5 after the last cut is transferred as far as possible by the feed cradle 15 on to the front table part 9. After opening the gap 61, the guide plate 62 is then moved towards the rear edge 64 of the front table part 9 and thereby moves this last row completely on to the front table part against the guide plate 31. This row is then also fed to the further processing station 23 by means of the ejector 67.

When all the rows of small stacks 25 have been fed to the further processing station 23, the reduced pressure acting on the suction elements 53 is disconnected and the mobile alignment station 22 is moved to the placement table 21 again, so that the next initial stack, after its edges have optionally been trimmed, can be manipulated on the front table part 9 which has now become free.

FIGS. 1 to 4 show that a central connection 69 leads to the mobile alignment station 22. This connection comprises the pneumatic lines to the pneumatic cylinder or cylinders 47 or 57 to 59, respectively, and further comprises reduced pressure connections for the suction elements 53 and the electrical connections to the servomotor 34. The central connection 69 is coupled to the electronics unit which controls the units (pneumatic cylinders, servomotor, suction elements) of the mobile alignment station 22 and which can also comprise a distance recording system for determining the relative position of the mobile alignment station 22, i.e. perpendicular to the cutting plane. It is thereby possible, irrespective of the reference position of the feed cradle 15 and of the stack of material to be cut which is seated against the latter, to align the mobile alignment station 22 with respect to the cutting plane. This can be effected with respect to any desired location of the front table part 9. In particular, the advance movement data of the feed cradle 15 can be taken into account by means of the electronics, whereby the electric servomotor 34 can be operated depending on different extents of advance. In contrast, if a plurality of pneumatic cylinders 57, 58 and 59 is used instead of the electric servomotor 34, only a few extents of advance of the guide plate 31 can be produced, and one of the cylinders is employed for compensation when the guide plate 31 swivels.

Figure 18:
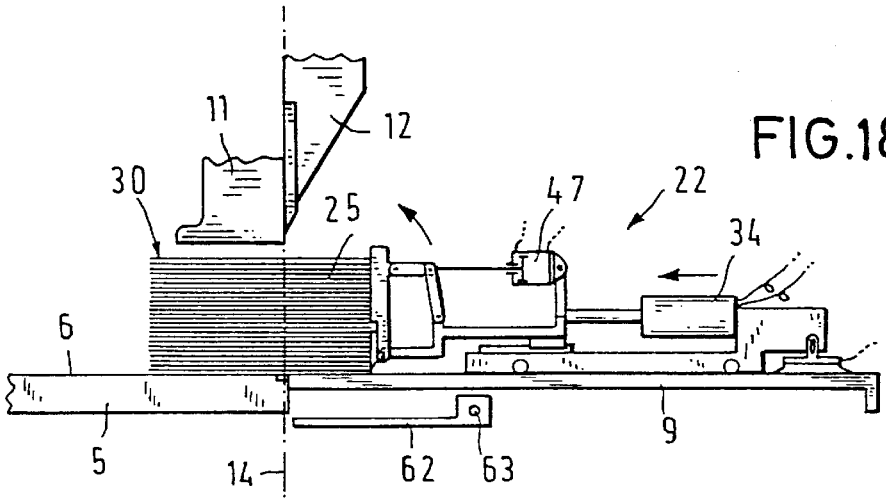
Figure 19:
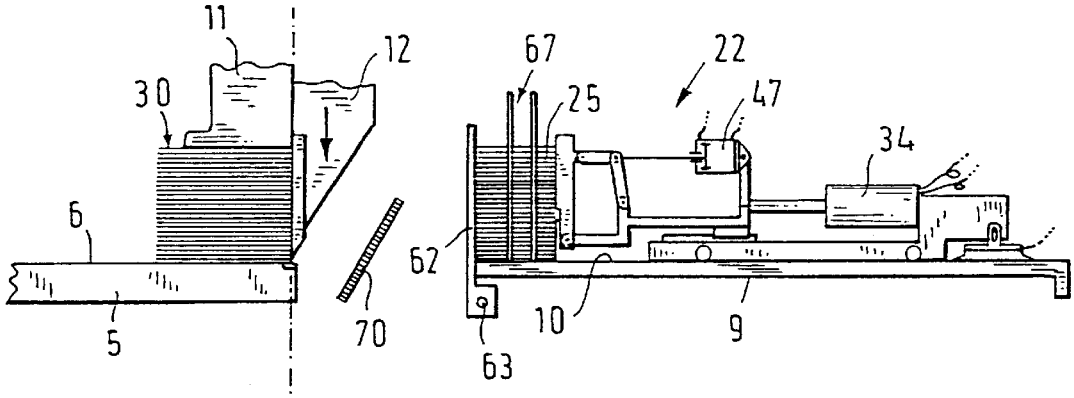

One extent of advance of the electric servomotor 34, which is operated via the electronics, or of the pneumatic cylinders 57 to 59, which are also operated electronically, is thus employed for compensation when the guide plate 31 swivels, and a second extent of advance is employed for adapting to the variable width of the material to be cut corresponding to the advance of the feed cradle. A third extent of advance should be considered to be associated with an intermediate cut which is inserted between two main cutting operations for the production of the row of small stacks 25. Reference is made to EP-A-0 056 874 with regard to the problems associated with intermediate cuts. A cutting operation taking into account an intermediate cut in which a thin strip of waste 70 is produced is illustrated in FIGS. 16 to 19. The conditions in FIG. 16 correspond to those in FIG. 11. After the cut, with the simultaneous swivelling of the guide plate 31 and the movement of the bearing element 33 slightly away from the cutting knife, an intermediate advance of the material to be cut is effected via the feed cradle 15, as shown in FIG. 17. It is necessary to move the bearing element 33 away from the cutting plane 14 by this extent by operating the electric servomotor 34. The small stacks 25 are then displaced into the shape of a right parallelepiped, as shown in the illustration of FIG. 18, by swivelling the guide plate 31 back, in the sense of the illustration of FIG. 14, into the position in which it is oriented perpendicularly to the table surface 10, with the pneumatic cylinder 47 and the electric servomotor 34 being operated. In order to form the gap 61, the front table part 9 is then moved away from the rear table part 5 and the guide plate 62 is swivelled towards the rear edge 64 of the front table part 9. The row of small stacks 25 is fed to the further processing station by means of the ejector 67 and at the same time the intermediate cut is made, during which the resulting strips of waste material 70 are disposed of downwards through the gap. This results in the situation shown in FIG. 14. The gap is subsequently closed again in the sense of the illustration of FIG. 15.

Figure 20:
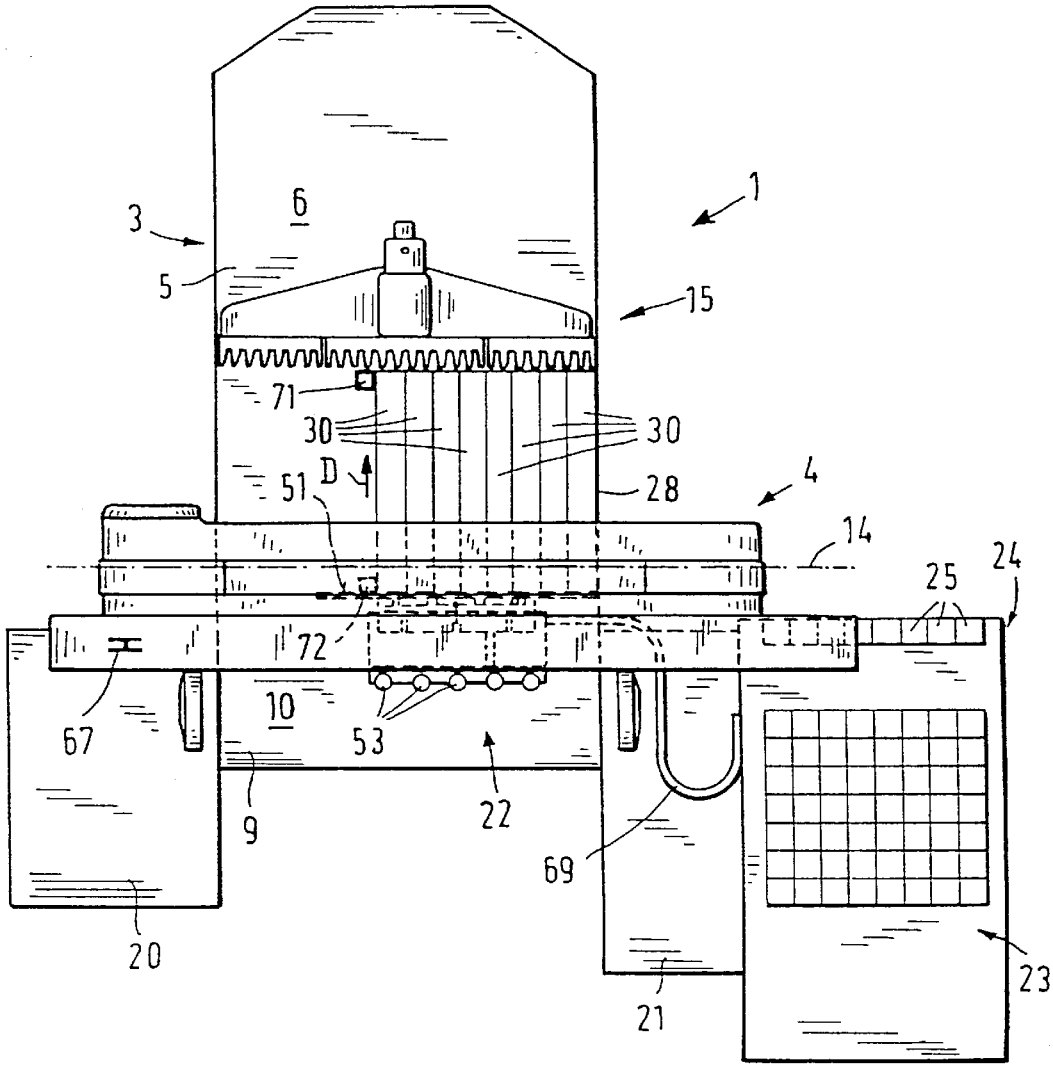
FIG. 20 shows a modified form of the guillotine cutter machine with lateral contact placement devices on the feeder device and on the first guide plate, as a view corresponding to that of FIG. 4.
Figure 21:
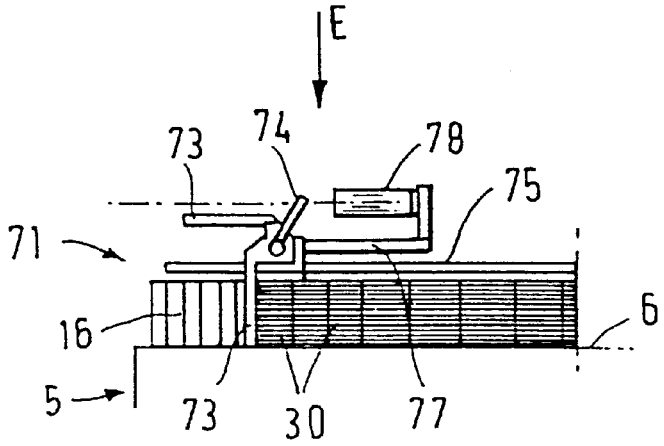
FIG. 21 is a detailed view of the lateral contact placement devices of the feeder device, as seen in the direction of arrow D in FIG. 20.
Figure 22:
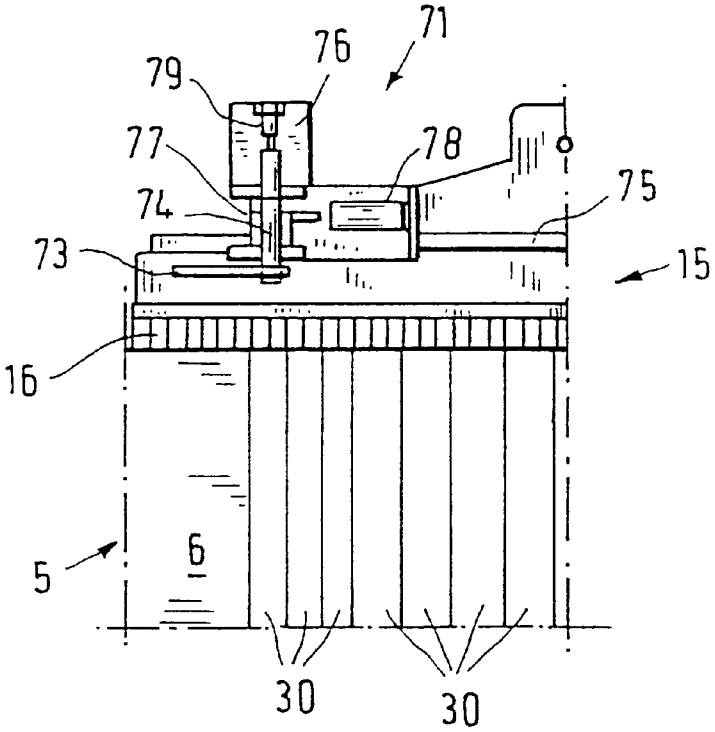
FIG. 22 is a view of the feeder device and of the lateral contact placement devices associated therewith, as seen in the direction of arrow E in FIG. 21.

The embodiment of the guillotine cutter machine 1 shown in FIG. 20 comprises a lateral contact placement device 71 fixed to the feed cradle 15 and a lateral contact placement device 72 fixed to the first guide plate 31 for placing the partial stack 30 against the fixed lateral contact placement device 28 of the rear table part 5. The construction and mode of operation of the lateral contact placement device 71 on the feed cradle 15 are illustrated in greater detail in FIGS. 21 and 22, and the construction and mode of operation of the lateral contact placement device 72 on the first guide plate 31 are illustrated in greater detail in FIG. 24. FIG. 21 shows a contact placement guide plate 73 with a guide shaft 74 in a parked position. A contact placement device guide 75, on which a receiver 76 can slide, is provided for size adjustment. The contact placement guide device receives a swivelling receiver 77 in which a swivelling cylinder 78 is mounted. The latter is employed for swivelling the contact placement guide plate 73 by 90° from its horizontal parked position shown in FIG. 21 into its vertical operating position which is shown in FIG. 22. The contact placement guide plate 73 can be moved, by means of a displacement cylinder 79 mounted in the receiver 76, into the operating region in front of the feed cradle 15 and back, so that the contact placement guide plate 73 is placed outside the region of action of the grid 16 of the feed cradle 15. This is necessary when the feeder device is advanced to is maximum extent and the grid 16 of the feeder device 15 meshes and cooperates with the section of the press crosshead 11 which is of correspondingly grid-like construction and accordingly the contact placement device 71 has to be situated outside this region of action of the feed cradle 15 and the press crosshead 11. The lateral contact placement device 72 of the first guide plate 31 comprises a guide shaft 80 for size adjustment, which is disposed parallel to the pivots 39 and is mounted in the actual guide plate body 51. A housing 81, which receives a contact placement cylinder 82, is mounted on the guide shaft. A contact placement guide plate 83, which is parallel to the actual guide plate body 51, is mounted in the contact placement cylinder. The manner of adjusting the housing 1 on the guide shaft 80 is not illustrated in the Figure, but can be effected via any desired means, for example by means of an electric servometer or mechanically. The lateral contact placement devices 71 and 72 are controlled via the machine electronics. The contact placement device 72 is situated in that region of the guide plate 31 or of the mobile alignment station 22 which faces away from the further processing station 23. The length of the guide plate 31 of the mobile alignment station 22 is of course designed so that the contact placement device 72 is situated outside the region which is taken up by the small partial stacks 25.

Figure 23:
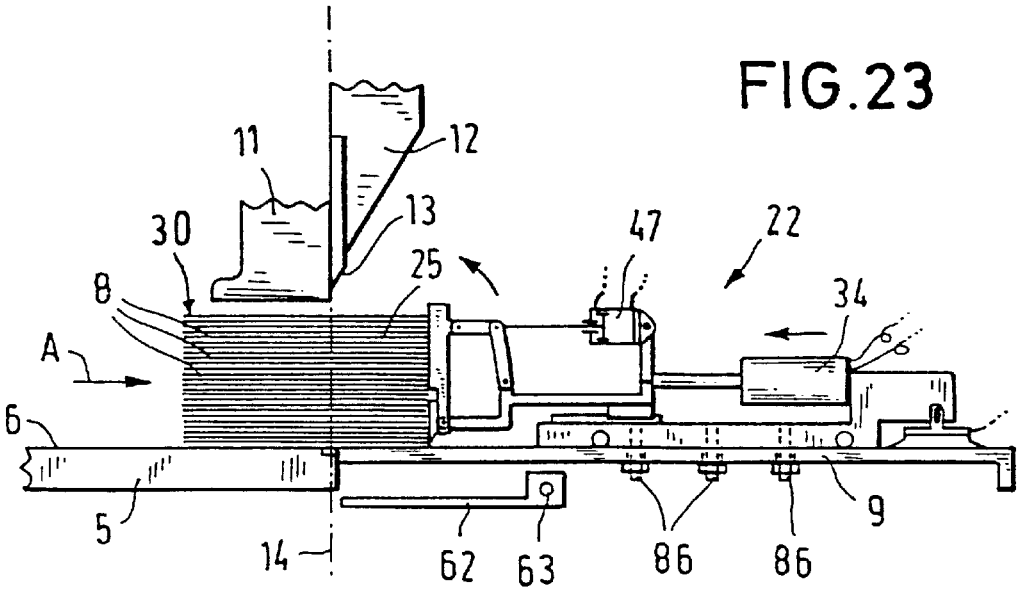
FIG. 23 shows a modified form of the device for fixing the mobile alignment station to the front table part, as a view corresponding to that of FIG. 10.
Figure 25:
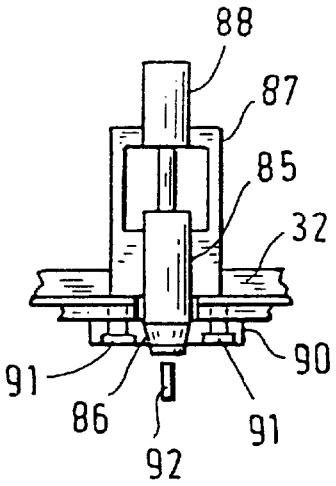
FIG. 25 is a section, on an enlarged scale, through the device for centring the mobile alignment station and the front table part.
Figure 24:
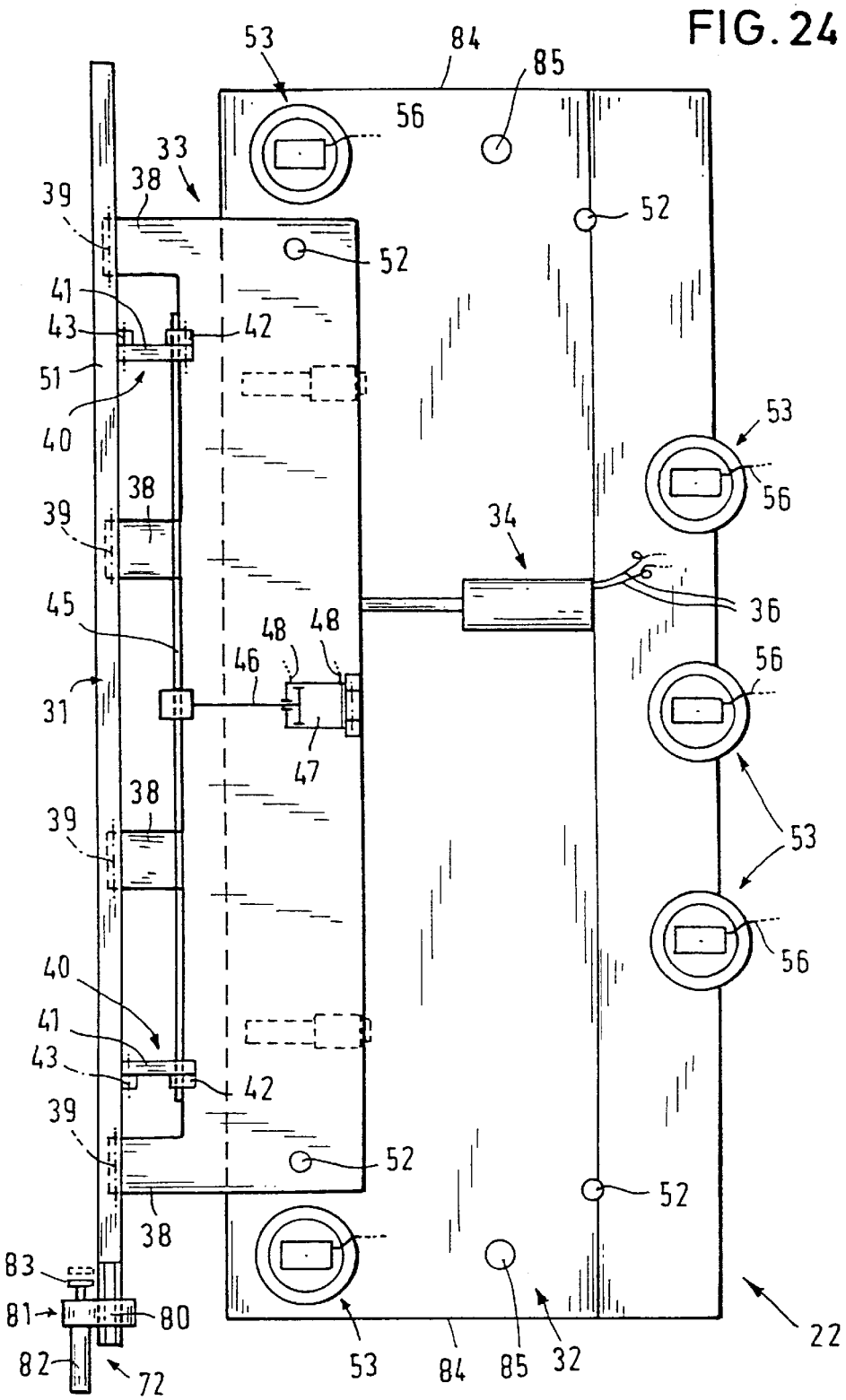
FIG. 24 shows a modified form of the mobile alignment station with lateral contact placement devices and centring pins, as a view according to that of FIG. 9.

FIGS. 23 to 25 illustrate the form of the device for centring the mobile alignment station 22 with respect to the front table part 9. As can be seen in the illustration of FIG. 24, the mobile alignment station 22, or specifically the plate-shaped base element 32 thereof, is provided for centring with two centring pins 85 which are disposed in the region of the end faces 84 of the base element 32 and which can be brought into active communication with centring receivers embedded in the front table part 9. The centring pins 85 are disposed in a plane which is positioned parallel to the cutting plane 14 of the cutter 13. As shown in the illustration of FIG. 23, centring receivers 86 are provided in pairs in the front table part 9 at different spacings, in this instance at three different spacings, from the cutting plane 14, so that the plate-shaped base element 32 can be positioned at three different spacings from the cutting plane 14. The positioning spacings are identical, namely the first positioning plane is at the same distance with respect to the associated centring receivers 86 from the second centring plane as is the third centring plane from the second centring plane. FIG. 25 illustrates the construction of the centring device which is associated with the respective centring pin 85. A housing 87 is mounted in the plate-shaped base element 32, and receives a pneumatic cylinder 88 by means of which the centring pin 85 can be moved vertically towards the table surface 10 of the front table part 9 with the mobile alignment station 22 resting thereon. The lower end of the centring pin 85 is of tapered construction and passes through the correspondingly tapered centring receiver 86 in a centring plate 90 which is embedded in the front table part 9 and is attached thereto by means of various fixing elements 91. The centring plate can be adjusted towards the cutting plane 14 via adjustable bushes associated with the fixing elements 91, so that absolute parallelism is ensured between the cutting plane 14 and the guide plate 31 when the latter is in its vertical position. When the centring pin 85 is inserted in the centring receiver 86, contact is made with a limit switch 92 associated with the centring receiver 86, by means of which the precise positioning of the mobile alignment station 22 on the front table part 9 can be monitored. In order to change the position of the alignment station 22, it is merely necessary to raise the two centring pins 85 thereof into their disengaged position and to bring the base element 32 into a new position in which the centring pins 85 are aligned with the associated centring receivers 86, and to lower the centring pins 85 into the centring receivers again. The actual positions of the first guide plate 31 which are necessary during the operation of the guillotine cutter machine can be set via these predetermined, defined positions of the plate-shaped base element 32 of the mobile alignment station 22 in relation to the front table part 9 and via the positions, which are also known, of the adjusting elements for the first guide plate 31. The pneumatic cylinders 88 and the limit switches 92 are operated via the machine electronics.

Figure 26:
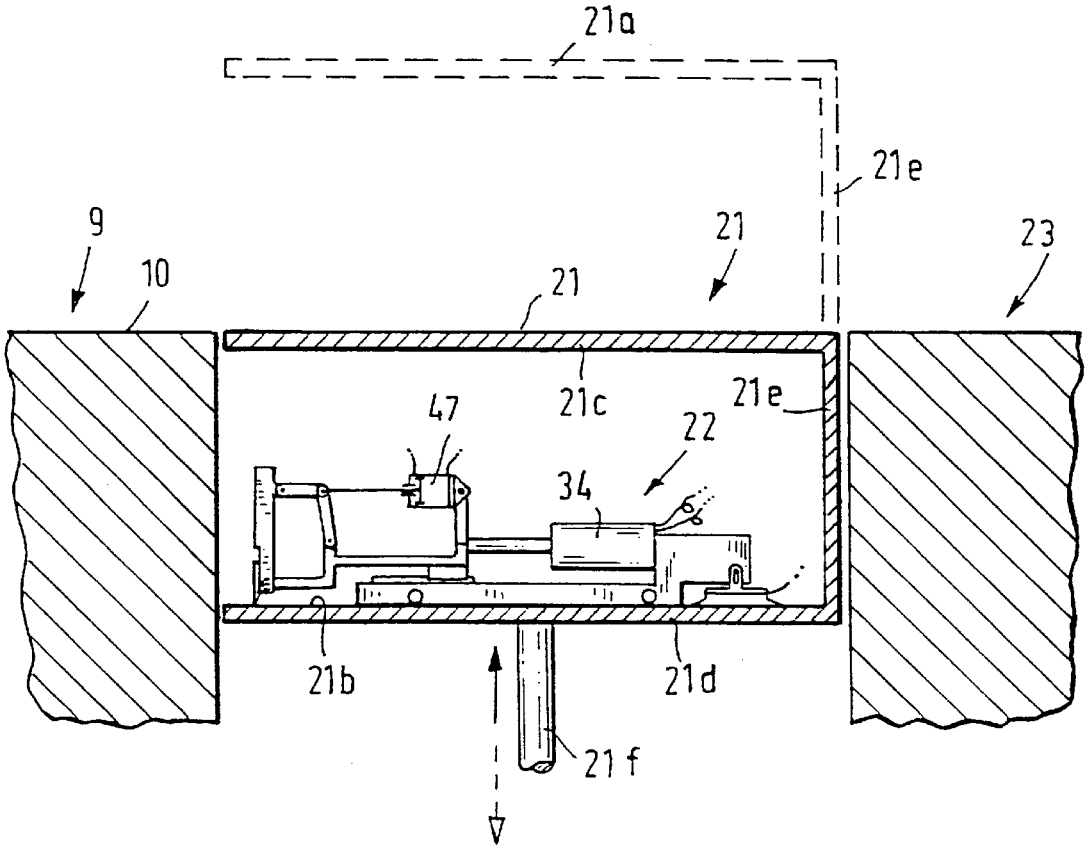
FIG. 26 shows a modified form of the additional table part for receiving the mobile alignment station when the latter is not required.

FIG. 26 shows a modified design of the right-hand placement table 21. This comprises two table planes 21*a* and 21*b* disposed in parallel one above the other, the table parts 21*c* and 21*d* which are associated with these two table planes being joined by means of a stay 21*f*. A lifting rod 21*e*, with which the placement table 21 as a whole can be raised and lowered, is attached to the underside of table part 21*d*. In the lowered position which is shown by the unbroken lines in FIG. 26, the surface of the upper table part 21*c* forms a plane with the surface of the front table part 9. In the raised position of table part 21*c*, however, the surface 21*b* of the lower table part 21*d* forms a plane with the surface 10 of the front table part 10. The surface 21*b* serves to receive the mobile alignment station 22 when the latter is not required.

The invention claimed is as follows:

1. A process for forming small stacks from an initial stack of sheet material by cutting, said process comprising:

providing a single guillotine cutter machine which comprises a rear table part for receiving the material to be cut and a front table part for receiving the cut material;

separating the initial stack into partial stacks by a plurality of cuts in a first direction perpendicular to a direction of feed thereof;

pushing back and rotating 90° at least a portion of the partial stacks from the front table part on to the rear table part for further cutting;

horizontally repositioning an alignment station with respect to the front table part to a position above the front table part, the alignment station including a first moveable guide plate;

advancing the partial stacks such that the partial stacks abut the first guide plate;

cutting the partial stacks in a second direction substantially perpendicular to the first direction to produce small stacks;

moving apart the front and rear table parts to form a gap between them;

placing a second movable guide plate substantially within the gap; and transporting the small stacks through a transverse channel formed between the two guide plates to a further processing station.

2. A process according to claim 1, wherein:

the first guide plate is positioned against the partial stacks to be cut when the alignment station is repositioned.

3. A process according to claim 1, wherein:

when the alignment station is repositioned, the position of the first guide plate in relation to a cutting plate of the cutting machine is determined by an electrical device.

4. A process according to claim 1, wherein:

when the alignment station is repositioned, the first guide plate is positioned in a defined manner with respect to the front table part.

5. A process according to claim 1, wherein:

the alignment station is centered with respect to a cutting plane of the guillotine cutter machine.

6. A process according to claim 1, wherein:

the alignment station is moved from an additional table part, which is disposed from the rear table part and the front table part, on to the front table part after the partial stacks have been pushed back on to the rear table part.

7. A process according to claim 1, wherein:

after the alignment station is repositioned to the front table part, the alignment station is attached thereto by a suction force.

8. A process according to claim 1, wherein:

the first guide plate, in a vertical position, is moved against the advanced partial stacks.

9. A process according to any one of claim 1, wherein:

when the partial stacks are cut, the first guide plate is tilted away from the cutter corresponding to a wedge shape of the cutting knife.

10. A process according to claim 9, wherein:

the tilted first guide plate is moved into a vertical position with the second guide plate oriented vertically.

11. A process according to claim 1, wherein:

the first guide plate is moved and pivoted horizontally.

12. A process according to claim 11, wherein:

the first guide plate is movable horizontally by differently defined distances.

13. A process according to claim 12, wherein:

the first guide plate is moved by an extent of advance for producing the small stacks and by an extent of advance for compensating for the pivoting movement of the first guide plate and by an extent of advance of an intermediate cut in combination with a disposal of a cutting waste through the gap.

14. A process according to claim 1, wherein:

at least a selected one of the first and the second guide plates is moved by a pneumatic actuator.

15. A process according to claim 14, wherein the actuator includes a plurality of pneumatic cylinders.

16. A process according to claim 1, wherein:

before or during the cut in the second direction the rotated partial stacks are fixed between one or more movable contact placement devices and a fixed lateral contact placement device of the rear table part.

17. A process according to claim 1, wherein:

before the initial stack is separated into partial stacks, the initial stack is trimmed at edges of the initial stack using the guillotine cutter machine.

18. A process according to claim 1, wherein:

at least a selected one of the first and the second guide plates is moved by an electrical actuator.

19. A process according to claim 18, wherein:

the actuator is an electric servomotor.

20. A process according to claim 1, wherein:

after the alignment station is horizontally repositioned to above the front table part, the alignment station is attached to the front table part by a magnetic force.

* * * * *

UNITED STATES PATENT AND TRADEMARK OFFICE

CERTIFICATE OF CORRECTION

PATENT NO. : 6,601,490 B1
DATED : August 5, 2003
INVENTOR(S) : Gross et al.

It is certified that error appears in the above-identified patent and that said Letters Patent is hereby corrected as shown below:

Column 2,
Line 61, “particularly” should be -- particular --.

Column 3,
Line 41, after “according” insert -- to --.

Column 10,
Line 41, delete “of”
Line 63, “servometer” should be -- servomotor --.

Column 13,
Line 26, “servometer” should be -- servomotor --.
Line 67, “bushes” should be -- bushings --.

Column 15,
Line 29, delete “any one of”.

Signed and Sealed this

Seventeenth Day of February, 2004

JON W. DUDAS
*Acting Director of the United States Patent and Trademark Office*